US009530598B2

(12) United States Patent
Pan

(10) Patent No.: US 9,530,598 B2
(45) Date of Patent: Dec. 27, 2016

(54) RELAY AND FLAG ASSEMBLY FOR USE WITH RELAYS

(71) Applicant: SCHNEIDER ELECTRIC INDUSTRIES SAS, Rueil-Malmaison (FR)

(72) Inventor: Yijun Pan, Singapore (SG)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/525,463

(22) Filed: Oct. 28, 2014

(65) Prior Publication Data

US 2015/0123750 A1 May 7, 2015

(30) Foreign Application Priority Data

Nov. 6, 2013 (SG) ..... 201308246-6

(51) Int. Cl.
*H01H 51/22* (2006.01)
*H01H 50/08* (2006.01)
(Continued)

(52) U.S. Cl.
CPC ..... *H01H 50/08* (2013.01); *H01H 9/16* (2013.01); *H01H 49/00* (2013.01); *H01H 50/06* (2013.01);
(Continued)

(58) Field of Classification Search
CPC ..... H01H 9/16; H01H 50/06; H01H 50/08; H01H 50/36; H01H 49/00; H01H 50/18; Y10T 29/49105
See application file for complete search history.

(56) References Cited

U.S. PATENT DOCUMENTS 4,771,253 A * 9/1988 Sasaki et al. ..... 335/17
4,890,080 A 12/1989 Hashimoto
(Continued)

FOREIGN PATENT DOCUMENTS

DE 2818684 A1 11/1978
EP 1471556 A2 10/2004

OTHER PUBLICATIONS

Extended European Search Report from corresponding European Application No. 14306764.3 dated Apr. 20, 2015.
(Continued)

*Primary Examiner* — Bernard Rojas
(74) *Attorney, Agent, or Firm* — Lando & Anastasi, LLP

(57) ABSTRACT

A relay and a method of assembling a relay are provided. The relay comprising: a relay switch configured to operate in a first switch mode and a second switch mode; a flag structure for indicating an operative status of the relay switch, the flag structure capable of being orientated in a first position for indicating the relay switch being in the first switch mode and in a second position for indicating the relay switch being in the second switch mode; a card structure coupled to the flag structure for changing the orientation of the flag structure from the first position to the second position or from the second position to the first position; and a base plate coupled to the flag structure and the card structure, the base plate comprising an open ended slot for allowing part of the flag structure to be received therein.

24 Claims, 13 Drawing Sheets

(51) Int. Cl.

| | |
|---|---|
| ***H01H 50/18*** | (2006.01) |
| ***H01H 50/36*** | (2006.01) |
| ***H01H 49/00*** | (2006.01) |
| ***H01H 9/16*** | (2006.01) |
| ***H01H 50/06*** | (2006.01) |

(52) U.S. Cl.
CPC ..... *H01H 50/18* (2013.01); *H01H 50/36* (2013.01); *Y10T 29/49105* (2015.01)

(56) References Cited

U.S. PATENT DOCUMENTS

| | | | | |
|---|---|---|---|---|
| 6,498,552 | B1 * | 12/2002 | Lozano Rico | 335/78 |
| 6,933,815 | B2 * | 8/2005 | Saruwatari et al. | 335/78 |
| 8,102,227 | B2 * | 1/2012 | Fujiwara et al. | 335/78 |

OTHER PUBLICATIONS

Office Action issued by the European Patent Office from corresponding European Patent Application No. 14306764.3 dated Jun. 20, 2016.

* cited by examiner

RELAY AND FLAG ASSEMBLY FOR USE WITH RELAYS

CROSS REFERENCE TO RELATED APPLICATION

This application claims the benefit under 35 U.S.C. §119 of Singapore Patent Application No. 201308246-6 filed on Nov. 6, 2013 which is hereby incorporated herein by reference in its entirety for all purposes.

TECHNICAL FIELD

The present disclosure relates broadly to a flag structure and a flag assembly for use in relays; and relays comprising the flag structure or flag assembly.

BACKGROUND

In the electronics industry, devices such as relays are typically used to operate machinery and circuits. Such devices typically rely on energization or switching on/off for operations. A flag structure is typically used in a relay to indicate to a user whether the relay is in an energized or de-energized state (i.e. switched on or off). Through mechanical interactions, the flag structure is typically actuated about one or more pivot points in response to the switching on/off operations to provide an indication of the switching states of the relay to the user.

In known relays, the flag structure is assembled by exerting a compressive or tensile force to at least partially deform a portion of the flag structure before aligning the deformed part to a support structure on the relay. Thereafter, the compressive or tensile force is released to allow the deformed part to recoil and urge against the support structure such that it engages with the support structure. The engagement with the support structure typically provides one or more pivot points for movement of the flag structure to provide an indication of the switching states of the relay to the user.

A significant problem that may arise from such conventional relay is that because a compressive or tensile force needs to be applied to the flag structure during assembly of the relay, the flag structure may sustain permanent deformation. In this case, the flag structure is not able to return to its original state. This can result in insufficient engagement of the flag structure with the support structure which in turn may hamper the movement of the flag structure in response to the switching of states of the relay. Consequently, there may be reduced efficiency or reduced accuracy in indicating the energization or de-energization of the relay. There is also a risk that the flag structure can be broken when excessive force is applied to the flag structure. This in turn can lead to unnecessary costs being incurred to replace the damaged components during assembly of the relay.

Another disadvantage in such known relays is that there is a separate need to apply a deformation force on the flag structure during assembly. This can slow down the entire assembly process and lead to low efficiency during the assembly process of the relay. Such reduced efficiency is even more pronounced on an industrial scale when large numbers of relays have to be assembled. There is also a degree of difficulty in automating the assembly process due to the need to apply a deformation force to the flag structure to properly fit the flag structure to a supporting structure of the relay.

Additionally, in known relays, the part of the flag structure that receives the mechanical force to enable the flag structure to actuate about one or more pivot points in response to the switching on/off operations, is often far from being structurally optimal. This may reduce the effectiveness in transmission of the mechanical force required for actuating the flag structure.

Due to the configuration of flag structures of known relays, certain components of the relays may only be assembled after the flag structure is put in place. The sequence of assembly of such known relays is restrictive. Furthermore, complicated toolings are needed to insert some components of the relay due to the positioning of the flag structure. This may reduce the efficiency of the assembly process. Manufacturing cost of the relay may also be increased due to the need for complicated toolings during the assembly process.

Hence, in view of the above, there exists a need for a relay, a flag structure and a flag assembly that address or at least ameliorate the above drawbacks.

SUMMARY

In accordance with an aspect, there is provided a relay comprising: a relay switch configured to operate in a first switch mode and a second switch mode; a flag structure for indicating an operative status of the relay switch, the flag structure capable of being orientated in a first position for indicating the relay switch being in the first switch mode and in a second position for indicating the relay switch being in the second switch mode; a card structure coupled to the flag structure for changing the orientation of the flag structure from the first position to the second position or from the second position to the first position; and a base plate coupled to the flag structure and the card structure, the base plate comprising an open ended slot for allowing part of the flag structure to be received therein.

The first switch mode may correspond to the relay operatively providing electrical communication to an external circuit and the second switch mode may correspond to the relay operatively disrupting electrical communication to the external circuit.

The open ended slot may be configured to allow part of the flag structure to be received therein without substantial deformation of the flag structure The flag structure may comprise projections for slotting into the open ended slot of the base to provide a pivoting point for changing the orientation of the flag structure.

The card structure may comprise a supporting platform for receiving part of the flag structure and for transmitting a force to the flag structure to change the orientation of the flag structure.

The flag structure may further comprise: a first arm and a second arm; a lip coupled to the first arm and the second arm for indicating the operative status of the relay switch; and a shaft coupled to the first arm and the second arm, the shaft configured to engage the supporting platform of the card structure, wherein the projections for being received in the open ended slot of the base plate comprises a projection extending from the first arm and a projection extending from the second arm.

The shaft may extend from the first arm to the second arm.

The projections may be disposed at the ends of the first and second arms.

The projection of the first arm and the projection of the second arm may extend outwards away from each other.

The relay may further comprise a housing for coupling with the base plate and for substantially preventing the projections of the flag structure from dislodging from the open ended slot of the base plate through the opened end.

The housing may comprise a window for allowing visual access to the lip of the flag structure when it is in the first position or the second position or both.

The window may be substantially transparent.

The flag structure may be substantially non-deformable.

In accordance with another aspect, there is provided a flag structure for use in a relay as disclosed herein, the flag structure comprising: a first arm and a second arm; a lip coupled to the first arm and the second arm for indicating the operative status of the relay switch; a shaft coupled to the first arm and the second arm, the shaft configured to engage the supporting platform of the card structure of the relay; a projection extending from the first arm; and a projection extending from the second arm, wherein the projection of the first arm and the projection of the second arm are arranged to be received by the open ended slot of the base of the relay.

The shaft may extend from the first arm to the second arm.

The projections may be disposed at the ends of the first and second arms.

The projection of the first arm and the projection of the second arm may extend outwards away from each other.

The flag structure may be substantially non-deformable.

In accordance with yet another aspect, there is provided a flag assembly for use in a relay as disclosed herein, the flag assembly comprising: a flag structure for indicating an operative status of a relay switch of the relay, the flag structure comprising: a first arm and a second arm; a lip coupled to the first arm and the second arm for indicating the operative status of the relay switch; and a shaft coupled to the first arm to the second arm for receiving a force to thereby change the orientation of the flag structure; and a card structure coupled to the flag structure, the card structure comprising a supporting platform for receiving the shaft of the flag structure and for transmitting the force to the flag structure to change the orientation of the flag structure.

The flag structure may further comprise: a projection extending from the first arm; and a projection extending from the second arm, wherein the projection of the first arm and the projection of the second arm are arranged to be received by the open ended slot of the base of the relay.

The projections may be disposed at the ends of the first and second arms.

The projection of the first arm and the projection of the second arm may extend outwards away from each other.

The flag structure may be substantially non-deformable.

In accordance with yet another aspect, there is provided a method of assembling a relay as disclosed herein, the method comprising: providing a base plate comprising an open ended slot; providing a flag structure for indicating an operative status of the relay switch, wherein the flag structure is capable of being orientated in a first position for indicating the relay switch being in the first switch mode and in a second position for indicating the relay switch being in the second switch mode; coupling a card structure to the base plate, wherein the card structure is capable of changing the orientation of the flag structure from the first position to the second position or from the second position to the first position; and receiving part of the flag structure with the open ended slot of the base plate.

The step of receiving part of the flag structure with the open ended slot of the base plate may comprise receiving the part of the flag structure with the open ended slot without substantially deforming the flag structure.

The method may further comprise engaging the supporting platform of the card structure with the shaft of the flag structure when the card structure comprises a supporting platform and the flag structure comprises a shaft.

BRIEF DESCRIPTION OF THE DRAWINGS

FIG. 2(*b*) is a schematic drawing of the flag structure in the example embodiment of FIG. 1.

FIG. 3(*b*) is a schematic drawing illustrating an exploded view of the open ended slot of a support structure in the example embodiment of FIG. 1.

FIG. 4(*b*) and FIG. 4(*c*) are schematic drawings illustrating other perspectives of the card structure in the example embodiment of FIG. 4(*a*).

FIG. 9(*b*) is a schematic drawing of a cross-section of a possible open ended slot in an example embodiment.

FIG. 9(*c*) is a schematic drawing of a cross-section of a non-open ended slot as a comparison against open ended slots of various example embodiments.

DETAILED DESCRIPTION

Figure 1:
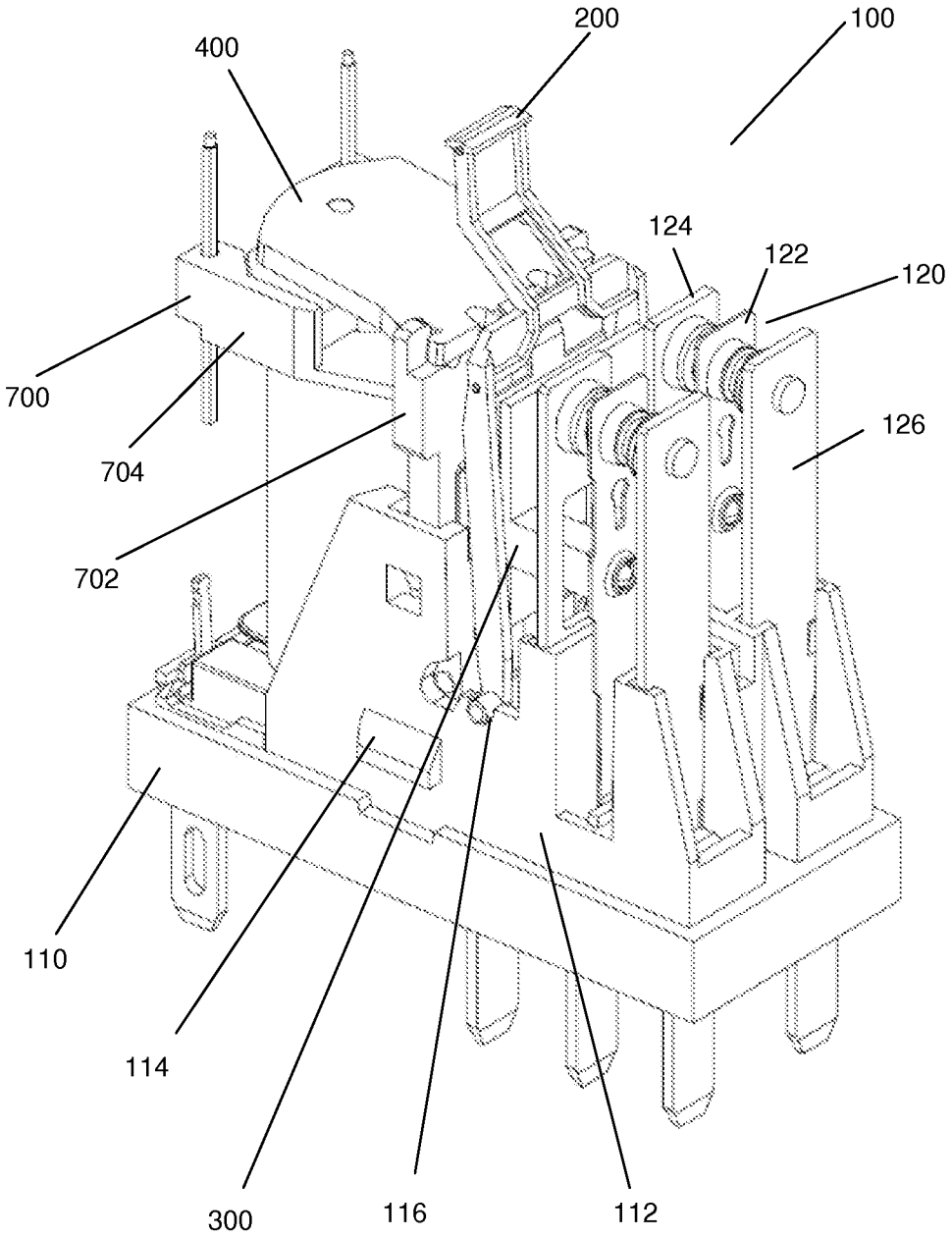
FIG. 1 is a schematic drawing of a relay in an example embodiment.

Example embodiments described herein provide a flag structure and a flag assembly for use in relays. Example embodiments disclosed herein also provide relays comprising the flag structure or flag assembly. The relays may be used for providing or disrupting electrical communication to an external circuit. The relays may be electromagnetic relays. Accordingly, in some embodiments, apart from the flag structure or flag assembly disclosed herein, the relays also comprise a coil block, an armature and a contact switching mechanism for electromagnetically switching on/off an electrical connection of the relay to an external circuitry.

In example embodiments, the relay for providing or disrupting electrical communication to a circuit comprise a relay switch configured to operate in a first switch mode and a second switch mode; a flag structure for indicating an operative status of the relay switch, the flag structure capable of being orientated in a first position for indicating the relay switch being in the first switch mode and in a second position for indicating the relay switch being in the second switch mode; a card structure coupled to the flag structure for changing the orientation of the flag structure from the first position to the second position or from the second position to the first position; and a base plate coupled to the flag structure and the card structure, the base plate comprising an open ended slot for allowing part of the flag structure to be received therein. The first switch mode and second switch mode may be independently selected to correspond to one of a mode for operatively providing electrical communication to an external circuit and a mode for operatively disrupting electrical communication to the external circuit. The open ended slot may be configured to allow part of the flag structure to be received or slotted therein without substantial deformation of the flag structure. The card structure and the base plate may be removably coupled to the flag structure.

In example embodiments, that open ended slot of the base plate is disposed on an extended structure of the base plate. The open ended slot may comprise at least one of a valley, trough, depression, or channel.

The flag structure may comprise projections for slotting into the open ended slot of the base to provide a pivoting point for changing the orientation of the flag structure. The flag structure may further comprise a first arm and a second arm; a lip coupled to the first arm and the second arm for indicating the operative status of the relay switch; and a shaft coupled to the first arm and the second arm, the shaft configured to engage the supporting platform of the card structure, wherein the projections for slotting into the open ended slot of the base plate comprises a projection extending from the first arm and a projection extending from the second arm. The first arm and second arm may be part of a frame structure that is bridged at the ends of the first and second arms by an elongate portion running across the two arms. The elongate portion may be disposed at an angle that is substantially perpendicular to the first, the second arms or both. The lip may also be coupled to the first and second arms via the elongate portion such that the lip may be an extension of part of the elongate portion. In some embodiments, the lip or part of the lip is an extension of the middle part of the elongate portion. In some embodiments, the lip or part of the lip is also made with a material or colour that is sufficiently conspicuous to the user so that the user is able to have a better visual indication on the switching status of the relay when in use. The lip may also be angled such that a small arc movement of the legs of the flag may result in a large arc movement of the lip. Advantageously, this can improve the mechanical sensitivity of the flag in that a small movement may be needed to show the change in switching status of the relay. In some embodiments, the lip is also interchangeably termed as an indicator.

In some embodiments, the projections for slotting into the open ended slot of the base plate are disposed at the ends of the first and second arms. The projection of the first arm and the projection of the second arm may extend outwards away from each other or inwards towards each other. The projections of the first and second arms may be of a shape that is complementary to the shape of the open ended slot of the base plate so that the projections may engage with the open ended slot to provide one or more pivot points to actuate the flag structure. In some embodiments, the cross-section of the projections is circular in shape. In various embodiments, due to the structure of the open ended slot and the projections, the flag may be dropped or slotted into the open ended slot of the base plate such that the projections are in contact with the open ended slot. Advantageously, in various embodiments, the flag structure can be fitted into the open ended slot of the base plate without a need for substantial deformation of the flag structure. This provides ease in assembly of the flag structure in the relay. Accordingly, in some embodiments, the flag structure can be made of substantially non-deformable material. Advantageously, this may provide rigidity and structural integrity to the flag structure.

In some embodiments, the shaft of the flag structure may be at least one of a bar, a rod, or a straight elongated member. In other embodiments, the shaft of the flag structure may be non-straight. It will be appreciated that in various embodiments, the shaft of the flag structure can assume any shape so long as the shaft can engage with the corresponding supporting platform of the card structure. The shaft of the flag structure may extend from the first arm to the second arm. In various embodiments, the shaft of the flag structure is to be distinguished from the elongate portion bridging the ends of the first and second arms. The shaft of the flag structure may be positioned between the elongate portion and the projections at the ends of the first and second arms. Advantageously, the shaft may provide a means for receiving a mechanical force for the flag structure to move it. Even more advantageously, the shaft also provides additional support for the arms of the flag structure so that overall rigidity and structural integrity to the flag structure is further enhanced. As will be appreciated, the card structure of the relay may comprise a supporting platform for receiving part of the flag structure and for transmitting a force to the flag structure to change the orientation of the flag structure. Thus, the shaft may be of a shape that is complementary to the shape of the supporting platform of the card structure so that the shaft may sufficiently engage with the supporting platform of the card structure to receive the mechanical force required to actuate the flag structure. Advantageously, when the supporting platform of the card structure is sufficiently engaged with the shaft, the incidence of imbalance of the flag structure, particularly during movement is substantially reduced. The supporting platform of the card structure may be a valley or a groove. Thus, in some embodiments, the shaft is tubular in shape to sufficiently engage with the supporting platform.

When describing embodiments of the flag structure herein, references to different features have been made. It will be appreciated that one or more of these features may be formed as part of the entire flag structure or may be individual components that are later fitted or added to other individual components to collectively form the flag structure. For example, the shaft coupling the first arm and the second arm may be a separate component that is attached (removably or otherwise) to the first arm and second arm or the shaft may be a part of the entire flag structure that is formed, for instance, through extrusion molding. Likewise, the lip, the elongate portion bridging the ends of the first and second arms and the projections at the ends of the first and second arms may be separate components that are attached (removably or otherwise) to the other components or part of the entire flag structure that is formed.

In some embodiments, the relay comprises a housing for coupling with the base plate to contain the relay switch, the flag structure and the card structure. The housing may also substantially prevent the projections of the flag structure from dislodging from the open ended slot of the base plate, for example, through the opened end of the open ended slot. In various embodiments, the housing comprises a window for allowing visual access to the lip of the flag structure when it is in the first position or the second position or both. The window may be substantially transparent.

In example embodiments, there is also provided a flag structure for use in a relay disclosed herein, the flag structure comprises a first arm and a second arm; a lip coupled to the first arm and the second arm for indicating the operative status of the relay switch; a projection extending from the first arm; and a projection extending from the second arm, wherein the projection of the first arm and the projection of the second arm are arranged to slot into the open ended slot of the base of the relay. The flag structure may also comprise additional features or configurations that are similar to those discussed above.

In example embodiments, there is also provided a flag assembly for use in a relay disclosed herein, the flag assembly comprises a flag structure for indicating an operative status of a relay switch of the relay and a card structure coupled to the flag structure, the card structure comprising a supporting platform for receiving the shaft of the flag structure and for transmitting the force to the flag structure to change the orientation of the flag structure. Additionally, the flag structure and card structure may also comprise additional features or configurations that are similar to those discussed above.

In example embodiments, there is also provided a method of assembling a relay disclosed herein, the method comprising providing a base plate comprising an open ended slot, providing a flag structure for indicating an operative status of the relay switch, wherein the flag structure is capable of being orientated in a first position for indicating the relay switch being in the first switch mode and in a second position for indicating the relay switch being in the first switch mode, coupling a card structure to the base plate, wherein the card structure is capable of changing the orientation of the flag structure from the first position to the second position or from the second position to the first position, and slotting part of the flag structure into the open ended slot of the base plate. The step of slotting part of the flag structure into the open ended slot of the base plate may comprise slotting the part of the flag structure into the open ended slot without substantially deforming the flag structure. The card structure may comprise a supporting platform and the flag structure may comprise a shaft. The method of assembling a relay may comprise engaging the supporting platform of the card structure with the shaft of the flag structure.

The terms "coupled" or "connected" as used in this description are intended to cover both directly connected or connected through one or more intermediate means, unless otherwise stated.

The description also discloses relevant device/apparatus for performing the steps of the described methods. Such apparatus may be specifically constructed for the purposes of the methods, or may comprise a general purpose computer/processor or other device selectively activated or reconfigured by a computer program stored in a storage member. The algorithms and displays described herein are not inherently related to any particular computer or other apparatus. It is understood that general purpose devices/machines may be used in accordance with the teachings herein. Alternatively, the construction of a specialized device/apparatus to perform the method steps may be desired.

Additionally, when describing some embodiments, the disclosure may have disclosed a method and/or process as a particular sequence of steps. However, unless otherwise required, it will be appreciated the method or process should not be limited to the particular sequence of steps disclosed. Other sequences of steps may be possible. The particular order of the steps disclosed herein should not be construed as undue limitations. Unless otherwise required, a method and/or process disclosed herein should not be limited to the steps being carried out in the order written. The sequence of steps may be varied and still remain within the scope of the disclosure.

Further, in the description herein, the word "substantially" whenever used is understood to include, but not restricted to, "entirely" or "completely" and the like. In addition, terms such as "comprising", "comprise", and the like whenever used, are intended to be non-restricting descriptive language in that they broadly include elements/components recited after such terms, in addition to other components not explicitly recited. Further, terms such as "about", "approximately" and the like whenever used, typically means a reasonable variation, for example a variation of +/−5% of the disclosed value, or a variance of 4% of the disclosed value, or a variance of 3% of the disclosed value, a variance of 2% of the disclosed value or a variance of 1% of the disclosed value.

Furthermore, in the description herein, certain values may be disclosed in a range. The values showing the end points of a range are intended to illustrate a preferred range. Whenever a range has been described, it is intended that the range covers and teaches all possible sub-ranges as well as individual numerical values within that range. That is, the end points of a range should not be interpreted as inflexible limitations. For example, a description of a range of 1% to 5% is intended to have specifically disclosed sub-ranges 1% to 2%, 1% to 3%, 1% to 4%, 2% to 3% etc., as well as individually, values within that range such as 1%, 2%, 3%, 4% and 5%. The intention of the above specific disclosure is applicable to any depth/breadth of a range.

Example embodiments of the disclosure will be better understood and readily apparent to one of ordinary skill in the art from the following discussions and if applicable, in conjunction with the Figures. It should be appreciated that other modifications related to structural, electrical and optical changes may be made without deviating from the scope of the invention. Example embodiments are not necessarily mutually exclusive as some may be combined with one or more embodiments to form new exemplary embodiments.

FIG. 1 is a schematic drawing illustrating a relay in an example embodiment. In the example embodiment, the relay 100 comprises a base 110, a contact switching mechanism 120, a flag structure 200, a card structure 300 and an armature 400. The base 110 comprises a supporting structure 112 for receiving the flag structure 200 and the contact switching mechanism 120. The supporting structure 112 further comprises an open ended slot 116 in the form of a top open ended slot (only one of the top open ends is shown in FIG. 1). The base 110 and the supporting structure 112 may be collectively termed as the base plate in this example embodiment.

In this example embodiment, the supporting structure 112 further comprises a locking portion 114. The locking portion 114 extends out towards an exterior of the relay 100.

The flag structure 200 is supported on the card structure 300. The flag structure is configured to be dropped into a top open end 116 of the supporting structure 112. The contact switching mechanism 120 comprises a movable contact piece 122, a first non-movable contact piece 124 and a second non-movable contact piece 126. The card structure 300 is in fitting contact with the armature 400 and the card structure 300 is coupled to the movable contact piece 122.

The contact switching mechanism 120 is coupled to the supporting structure 112, for example, by fitting the movable contact piece 122, the first non-movable contact piece 124 and the second non-movable contact piece 126 into corresponding receiving guides in the supporting structure 112 of the base 110.

Figure 2A:
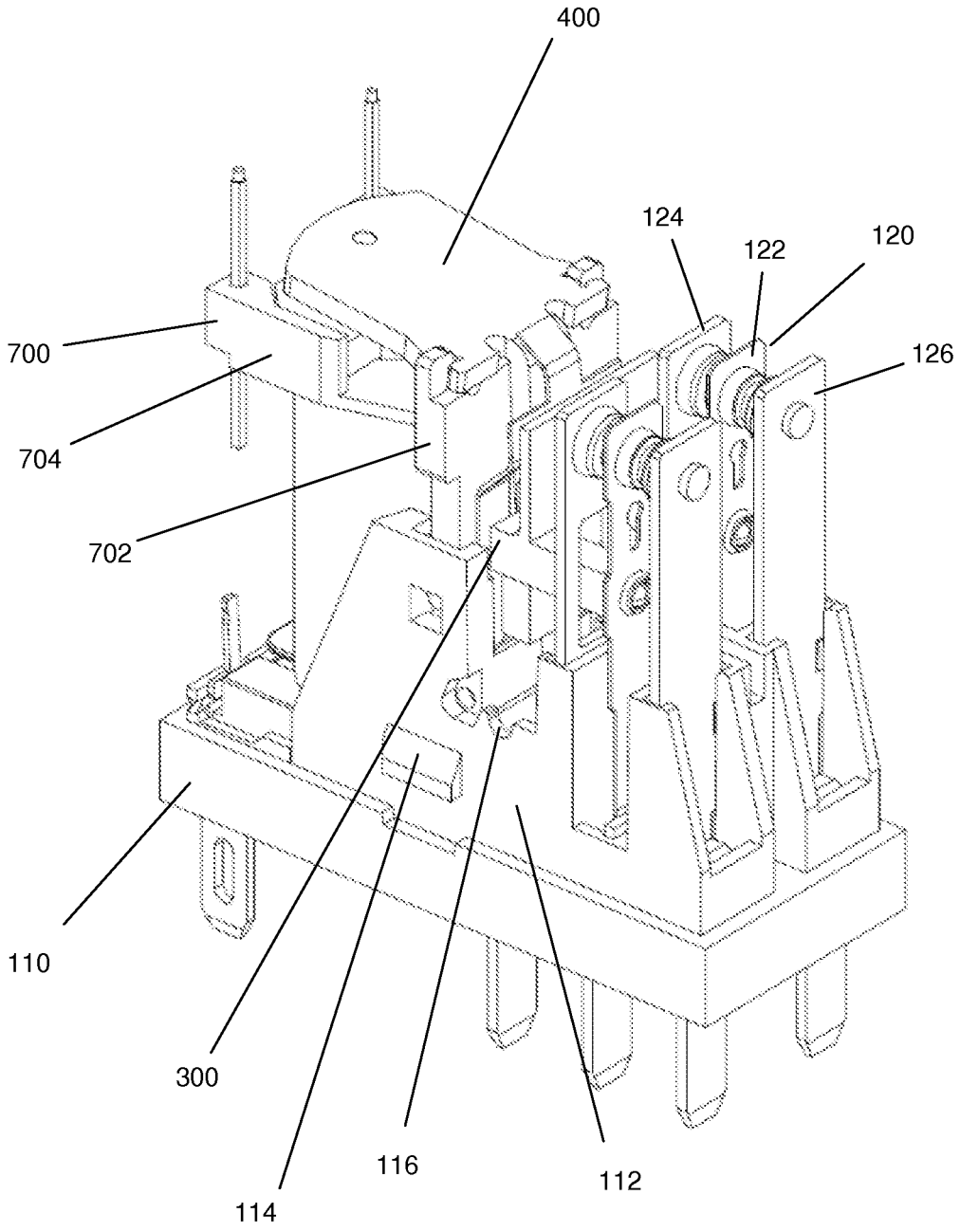
FIG. 2(*a*) is a schematic drawing of a part of the relay without a flag structure in the example embodiment of FIG. 1.
Figure 2B:
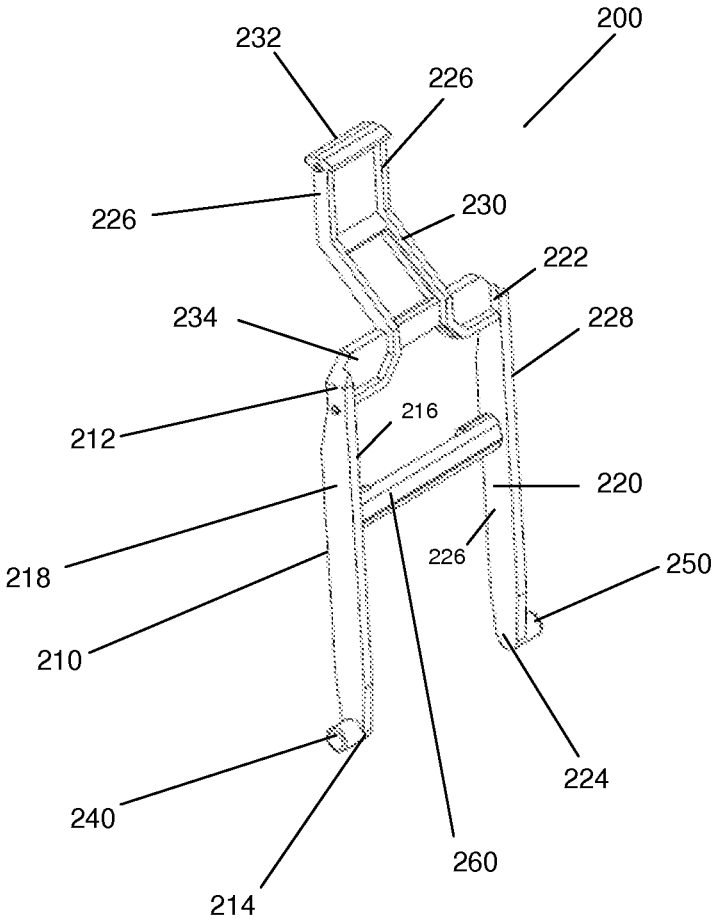

FIG. 2(*a*) is a schematic drawing illustrating a part of the relay 100 before assembly of a flag structure in the example embodiment of FIG. 1. The card structure 300 is placed between a contact switching mechanism 120 and an armature 400.

FIG. 2(*b*) is a schematic drawing illustrating the flag structure 200 in the example embodiment of FIG. 1. The flag structure 200 comprises a first arm 210, a second arm 220 and a lip in the form of an indicator portion 230. The indicator portion 230 is connected to a first end 212 and 222 of the first arm 210 and the second arm 220. The two arms 210 and 220 are substantially parallel to each other.

The first arm 210 comprises a first end 212, a second end 214, an inner wall 216 and an outer wall 218. Similarly, the second arm 220 comprises a first end 222, a second end 224, an inner wall 226 and an outer wall 228. The inner wall 216 of the first arm 210 faces the inner wall 226 of the second arm 220. A first projection 240 extends out from the outer wall 218 at the second end 214 of the first arm 210. A second projection 250 extends out from the outer wall 228 at the second end 224 of the second arm 220. The first projection 240 and the second projection 250 have a circular cross-section. Each of the two projections 240 and 250 is configured for dropping into a top open end 116 of the supporting structure 112 of base 110 of the relay 100.

The indicator portion 230 extends from an elongate portion that bridges the first arm 210 and second arm 220. The elongate portion is in the form of a connector bar 234. The indicator portion 230 also comprises an indication point 232 and a connector piece 226. The indication point 232 is connected to the connector bar 234 by the connector piece 226. The connector bar 234 is substantially perpendicular to each of the two arms 210 and 220. The indication point 232 is formed at a substantially centre position of the connector bar 234.

The flag structure 200 further comprises a shaft 260. The shaft 260 extends from one arm to another arm. The shaft 260 is substantially perpendicular to each of the arm 210 and 220. In this example embodiment, the shaft 260 is integral with the two arms 210 and 220. In other embodiments, the shaft 260 may be a part that is attached to the two arms 210 and 220. Advantageously, as the shaft 260 is a continuous extension from one arm to the other arm, a large surface is provided for engaging with a card structure. This allows the flag structure to be in better contact and alignment with the card structure during movement of the card structure so that less stress is being exerted on the flag structure during said movement.

It will be appreciated that in some embodiments, the flag structure 200 can be molded as single structure and in other embodiments the flag structure 200 can be assembled together from different parts.

The flag structure 200 is capable of cooperating with a card structure 300 of a relay 100 in the example embodiment.

In an example embodiment, the flag structure 200 is made of a substantially non-deformable material. The substantially non-deformable material can be a plastic, such as polybutylene terephthalate, polyphenylene sulfide, polyamides or polyoxymethylene, but is not limited to such material. In some embodiments, due to certain specific structural design, the structure design does not allow the flag structure 200 or part thereof to be substantially deformed. For example, multiple shafts can be disposed between the first arm 210 and the second arm 220 to make it more difficult for the first arm 210 and the second arm 220 to move towards or away from each other when a compressive or tensile force is exerted on the first arm 210 and the second arm 220. This helps to increase the rigidity of the flag structure 200.

Referring to FIGS. 1 and 2(*b*), the first projection 240 and the second projection 250 of the flag structure 200 operate as bearing/pivot points. When in use, the first arm 210 and the second arm 220 can rotate about the first projection 240 and the second projection 250 respectively. The shaft 260 is being supported on the card structure 300 and can be pushed or pulled along with the card structure 300. The flag structure 200 is thus enabled to move forward and backward with respect to the contact mechanism 120 accordingly.

Figure 3A:
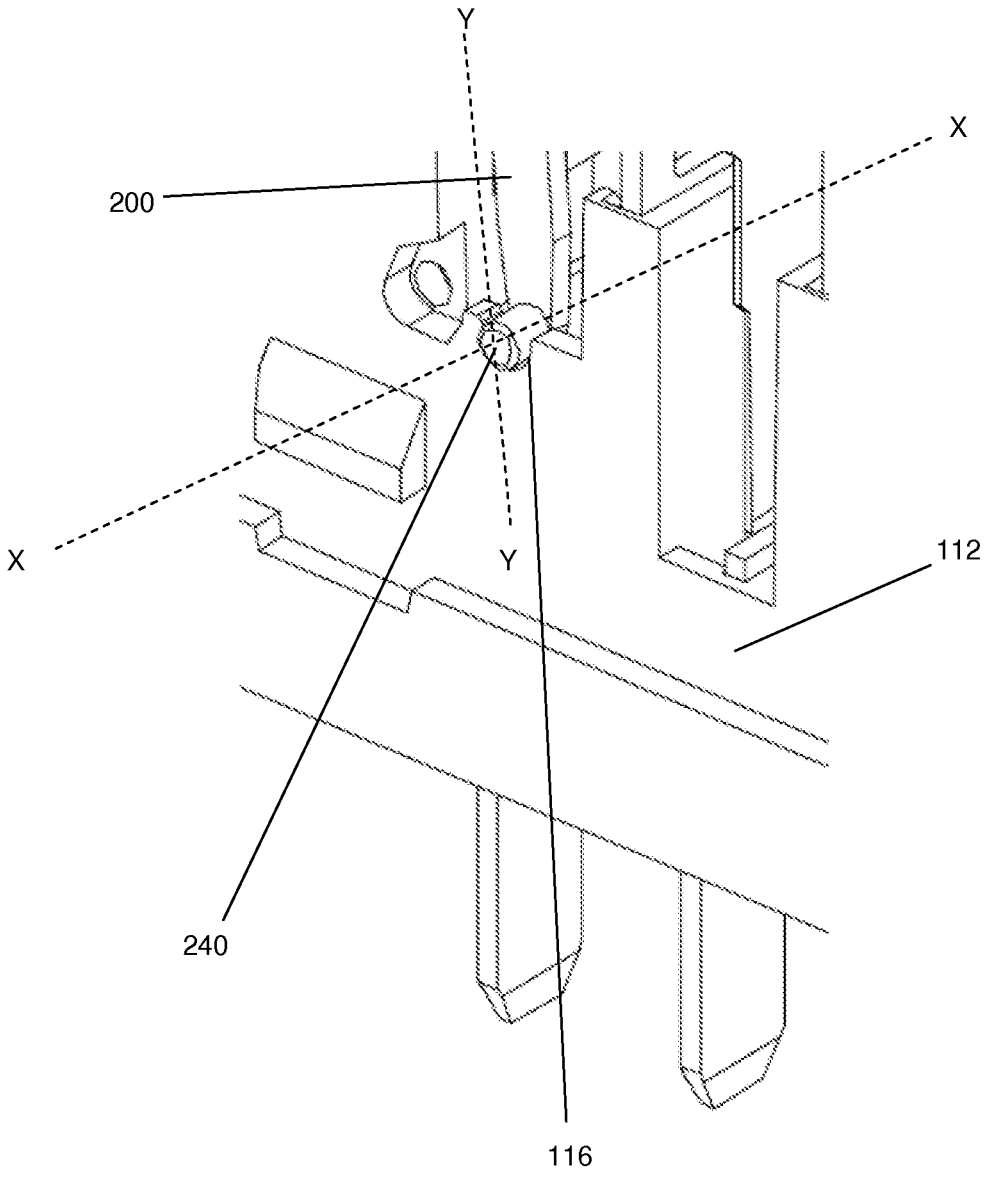
FIG. 3(*a*) is a schematic drawing illustrating an exploded view of an arm of the flag structure within an open ended slot of a support structure in the example embodiment of FIG. 1.
Figure 3B:
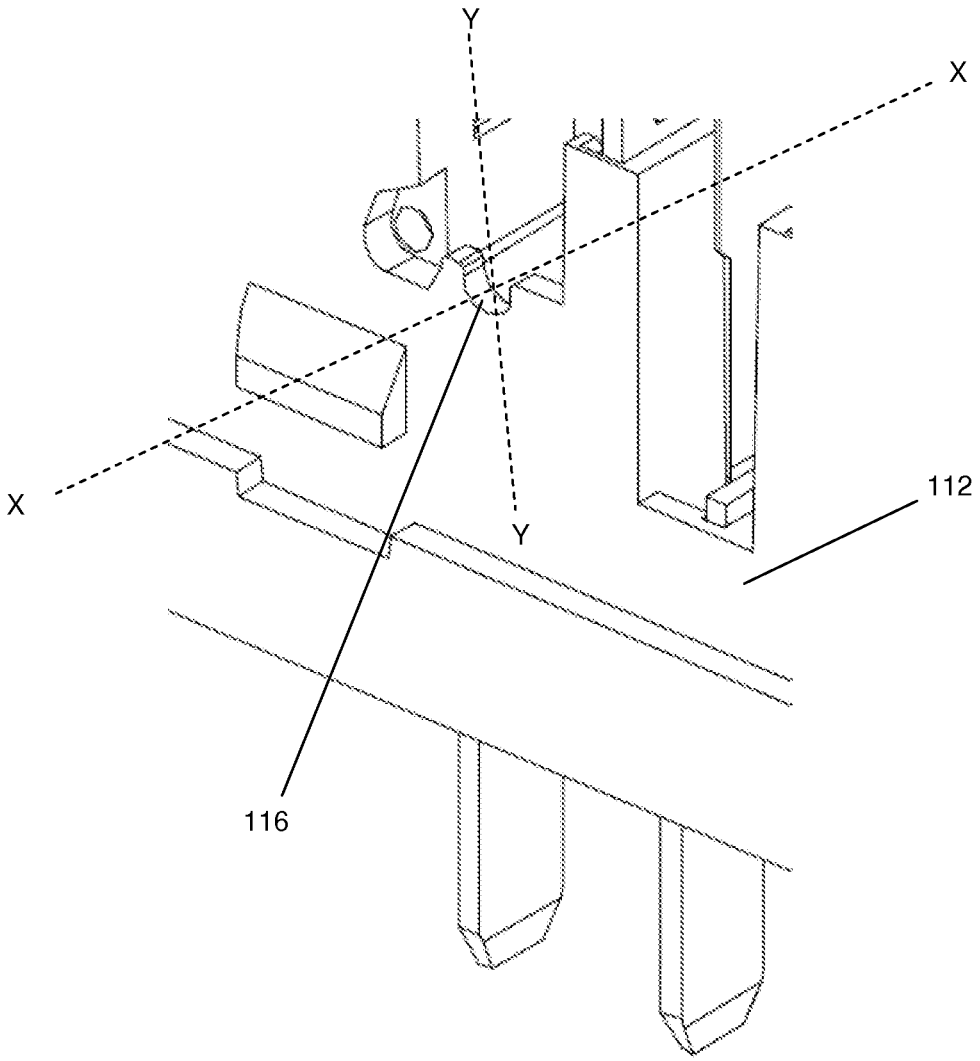

FIG. 3(*a*) is a schematic drawing illustrating an exploded view of the arm of the flag structure within the open ended slot 116 of the support structure 112 in the example embodiment of FIG. 1.

FIG. 3(*b*) is a schematic drawing illustrating an exploded view of the open ended slot 116 of the support structure 112 of FIG. 1 but in the absence of a flag structure.

Referring to FIG. 3(*a*) and FIG. 3(*b*), it can be seen that the top end of the slot 116 is opened to allow access into the slot from the top by the first projection 240. From a side view, it can be seen that the open ended slot 116 has a substantially "U" shape. The flag structure 200 is dropped, slotted into or rested on the top open ended slot 116 of the support structure 112 (only one of the top open ends is shown in FIG. 3(*a*)). The top open ends 116 are substantially complementary to the first projection 240 and the second projection (not shown in FIG. 3(*a*) and (*b*)) of the flag structure 200. Each of the projections 240 and 250 of the flag structure 200 fitted or received through the top open ends of the open ended slot 116 without substantial force or deformation of the flag structure. It will be appreciated that the open ended slot 116 for allowing part of the flag structure to be slotted therein is not an enclosed opening where the circumference of the opening is closed and access to the opening is provided only along a single axis (for example only the X-axis shown in FIGS. 3(*a*) and 3(*b*)). In this embodiment, two axes of entry into the slot (that is, the X-axis and Y-axis shown in FIGS. 3(*a*) and 3(*b*)) are possible. However, for ease of assembly, in this embodiment, the point of entry along the Y-axis is preferred (i.e. through the top open end) as substantial force or deformation of the flag structure is not required. In this example embodiment, the projections 240 and 250 can be slidably fitted into the top open ends 116. In alternative embodiments, it will be appreciated that the open ended slot can also have a single point of entry, such that entry is from a top down manner. For example, in these alternative embodiments, side walls can be provided to cover up entry access along the X-axis and allow entry only via the Y-axis.

In this particular embodiment, there is no need to deform the flag structure 200, for example by increasing the distance between the two arms or by decreasing the distance between the two arms, in order to fit each of the projections 240 and 250 into the top open ended slot 116. This also helps to reduce the possibility of a flag structure being broken or damaged in the process of assembling a relay which thus helps to increase efficiency and reduce production costs.

Figure 4A:
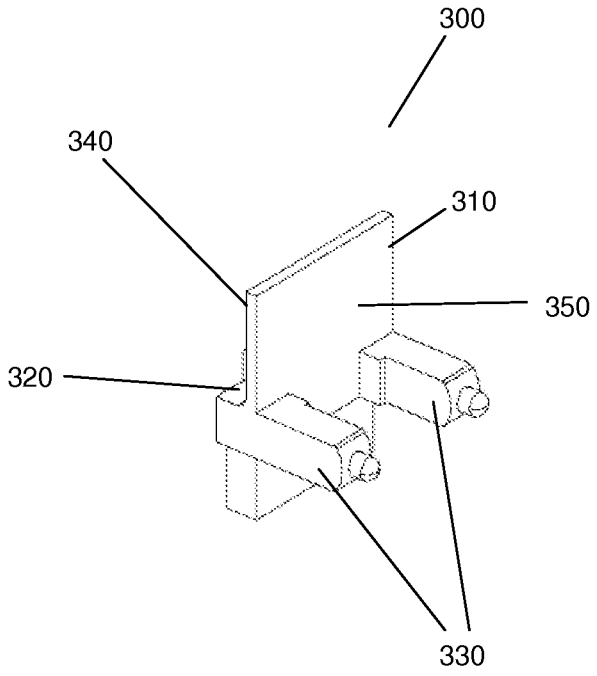
FIG. 4(*a*) is a schematic drawing of a card structure in the example embodiment of FIG. 1.
Figure 4B:
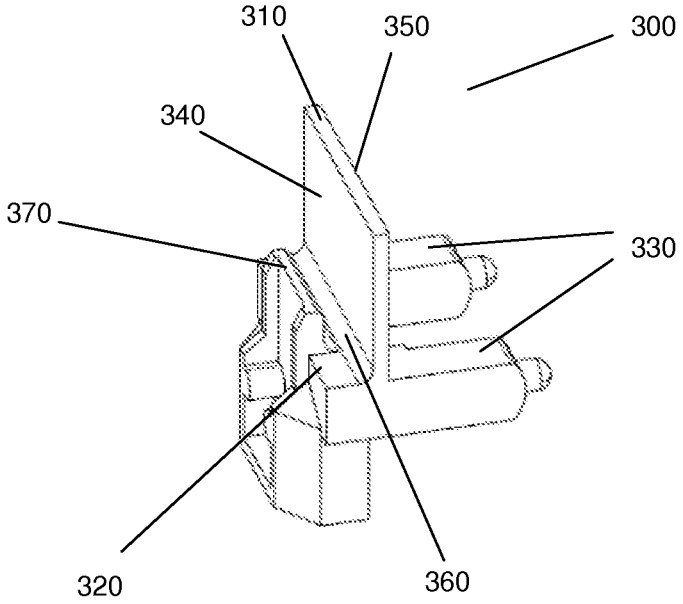
Figure 4C:
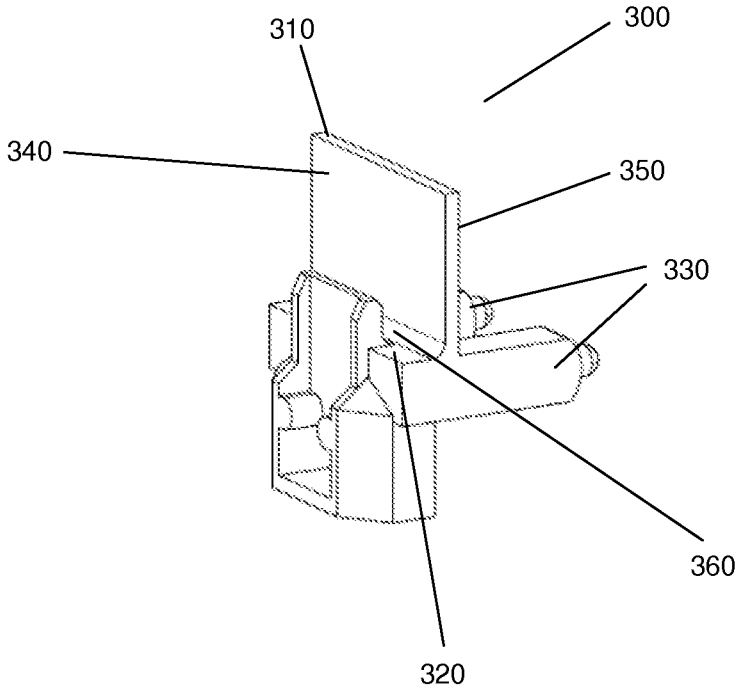

FIG. 4(*a*) is a schematic drawing illustrating the card structure in the example embodiment of FIG. 1. The card structure 300 comprises an upright wall 310, a supporting platform in the form of an extended portion 320 and two arms 330. The extended portion 320 extends from a first surface 340 and the two arms 330 extend from a second surface 350 of the upright wall 310. In this embodiment, the extended portion 320 further comprises a groove which can be better seen in FIG. 4(*b*) and FIG. 4(*c*).

FIG. 4(*b*) and FIG. 4(*c*) are schematic drawings illustrating other perspectives of the card structure in an example embodiment. The extended portion 320 of the card structure 300 further comprises a groove 360. In this example embodiment, the groove 360 is disposed between the first surface 340 and a panel 370. The groove 360, together with the first surface 340 and the panel 370 helps to prevent accidental movement or dislocation of the flag structure 200 from the card structure 300. In various embodiments, the groove 360 can be an indentation made on the extended portion 320 or any complementary structure to engage the corresponding shaft 260 of the flag structure 200.

In the particular example embodiment shown in FIG. 1, the shaft 260 of the flag structure 200 is placed onto the extended portion 320 of a card structure 300.

In another example embodiment, the shaft 260 of the flag structure 200 can be fitted onto a groove 360 on the extended portion 320 of the card structure 300.

Figure 5:
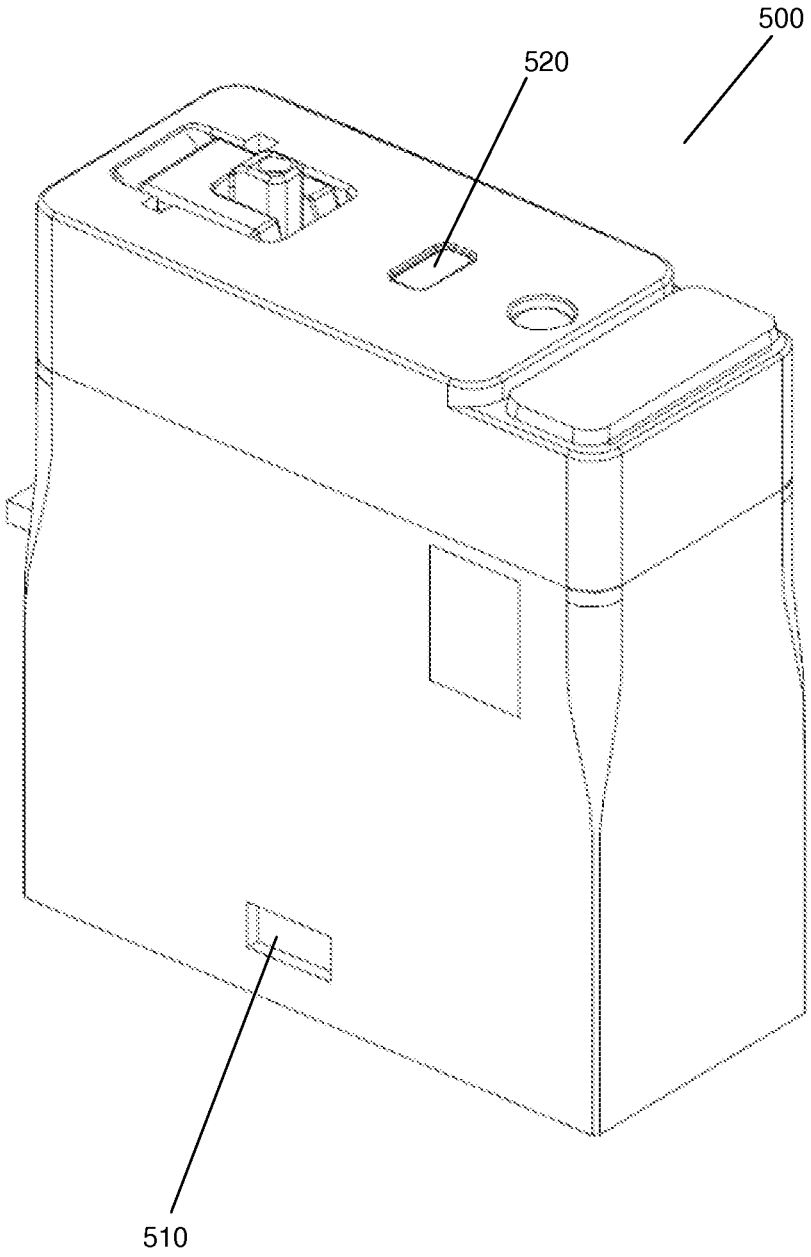
FIG. 5 is a schematic drawing of a relay being covered with a housing/shell in an example embodiment.

FIG. 5 is a schematic drawing illustrating a relay structure being covered with a housing in an example embodiment.

Figure 6:
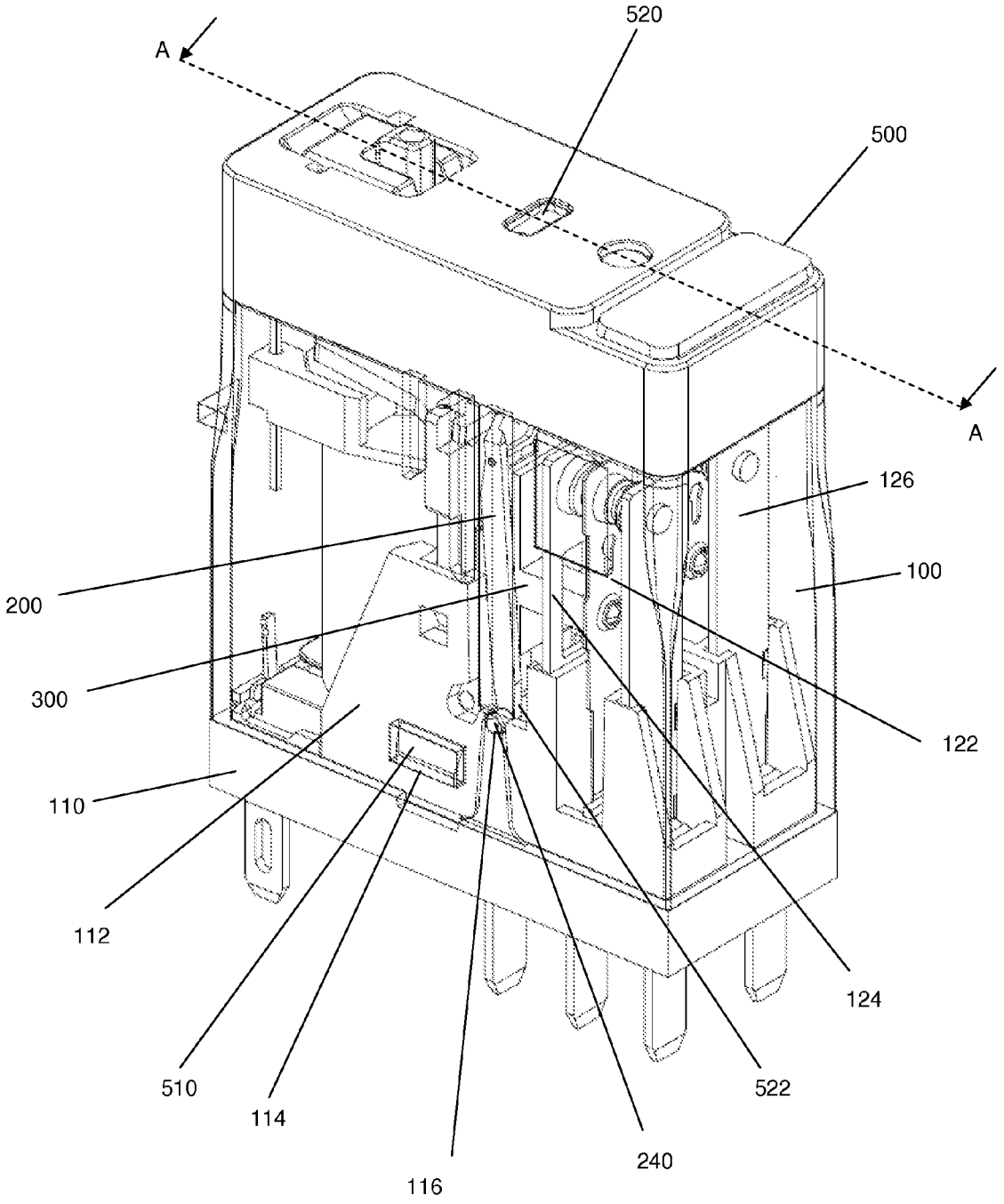
FIG. 6 is a detailed schematic drawing showing the internal components of the relay in FIG. 5.

FIG. 6 is a detailed schematic drawing of FIG. 5, where the internal components of the relay are shown for better illustration.

Referring to both FIGS. 5 and 6, a shell 500 is of a shape and size complementary to a relay 100. The housing/shell 500 comprises a window in the form of a recess 520 and a rib 522 (only one is shown in FIG. 6). The position of the rib 522 is such that when the shell 500 is coupled to the relay 100, the rib 522 rests on top of the projections 240 and 250 (not shown) of the flag structure. This substantially prevents the flag structure from being dislodged from the top open ended slot. In this example embodiment, the rib 522 is urged within a top open end of the supporting structure 112 and rests on top of the projections 240 and 250. In this arrangement, the projections 240 and 250 allow the flag structure 200 to rotate about the space formed by each rib 522 and the corresponding top open ended slot 116. In this example embodiment, the shell further comprises a locking hole 510. The locking portion 114 of the relay 100 locks into the locking hole 510. The shell 500 is thereby coupled to the relay 100.

In this embodiment, the recess 520 is substantially transparent. The recess 520 is positioned such that it corresponds to a position of an indication point (for example 232 of FIG. 2(*b*)) when the relay is in an energized state. When the relay is in a de-energized state, the recess 520 no longer corresponds to a position of the indication point (for example 232 of FIG. 2(*b*)). In alternative embodiments, the recess 520 can be positioned such that it corresponds to a position of an indication point when the relay is in a de-energized state. In such alternative embodiments, when the relay is in an energized state, the recess 520 no longer corresponds to a position of the indication point.

Figure 7:
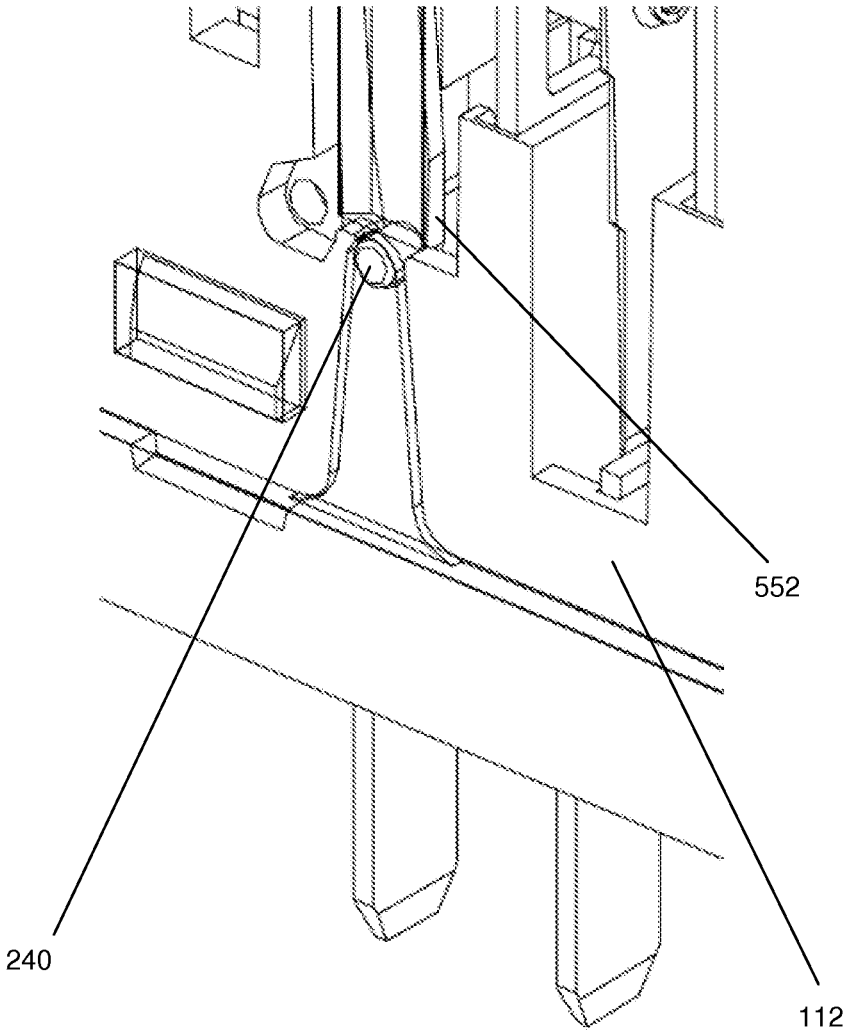
FIG. 7 is a schematic drawing of an exploded view of an arm of a flag structure with a rib of the housing/shell in the example embodiment of FIG. 5.

FIG. 7 is a schematic drawing illustrating an exploded view of the arm of the flag structure with the rib of the housing/shell in the example embodiment of FIG. 5. The rib 522 is placed on top of a protrusion of a flag structure in the example embodiment.

Figure 8A:
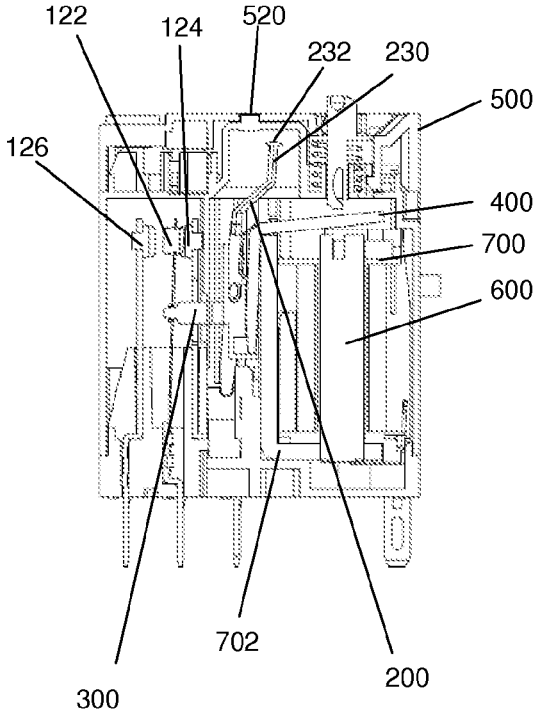
FIG. 8(*a*) and FIG. 8(*b*) are sectional views along the line AA of FIG. 6 with the relay in a de-energized state in FIG. 8(*a*) and the relay in an energized state in FIG. 8(*b*).
Figure 8B:
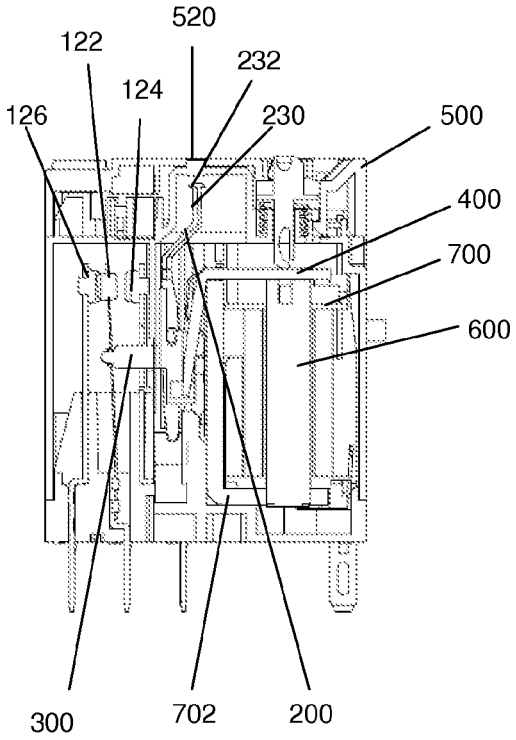

FIG. 8(*a*) and FIG. 8(*b*) are sectional views along the line AA of FIG. 6. Referring to FIG. 8(*a*), when the relay is in a de-energized state, the armature 400 is not in contact with an iron core 600. The movable contact 122 is in contact with the first unmovable contact 124. The indicator portion 230 of the flag structure 200 lies at a position such that the indication point 232 is not aligned with the position of the recess 520 of the shell 500. In this position, the indication point 232 is not visible through the recess 520. A user is able to know that the relay is in a de-energized state due to the non-visibility of the indication point 232.

Referring to FIG. 8(*b*), when the relay is in an energized state, the armature 400 rotates in a clockwise direction. The armature 400 thus comes in contact with the iron core 600. The movable contact 122 comes into contact with the second unmovable contact 126. Movement of the armature 400 causes the card structure 300 to move in a direction that is away from the iron core 600. This movement of the card structure 300 translates to a rotation of the flag structure 300 in an anti-clockwise direction. The indicator portion 230 of the flag structure 200 lies at a position such that the indication point 232 is aligned with the position of the recess 520 of the shell 500. In this position, the indication point 232 is visible through the recess 520. A user is able to know that the relay is in an energized state due to the visibility of the indication point 232.

Referring to FIGS. 1, 2(*a*), 5 and (8), an example embodiment of a method of assembling a relay in an example embodiment is hereby described. A contact switching mechanism 120 and a coil subassembly 700 are assembled on a base 110. The coil subassembly 700 comprises a yoke 702, an iron core 600 and a frame 704. In this example embodiment, the contact switching mechanism is inserted into corresponding receiving guides in the base 110. An armature 400 is inserted into corresponding receiving guides in the coil subassembly 700. A card structure 300 is slotted between the armature 400 and the contact switching mechanism 120. An extended portion 320 of the card structure 300 is in fitting contact with the armature 400 and two arms 330 of the card structure 300 are coupled to a movable contact piece 122. A flag structure 200 is placed on top of the extended portion 320 of the card structure. For example, a shaft 260 of the flag structure 200 is fitted into a groove on the extended portion 320. A first arm 210 and a second arm 220 of the flag structure 200 are dropped into top open ended slot 116 of the projection 112 by slotting a first projection 240 and a second projection 250 of the flag structure 200 into the top open ends 116. A shell 500 is coupled to the relay 100 by placing ribs 522 of the shell 500 on top of the first projection 240 and the second projection 250. In the example embodiment, the ribs 522 are urged into the top open ends 116. In this position, a locking portion 114 of the base 110 locks into a locking hole 510 of the shell 500.

Figure 9A:
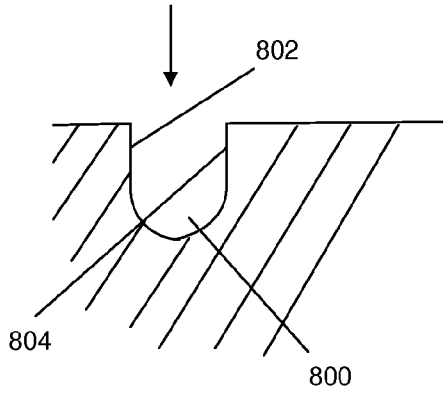
FIG. 9(*a*) is a schematic drawing of a cross-section of a possible open ended slot in an example embodiment.
Figure 9B:
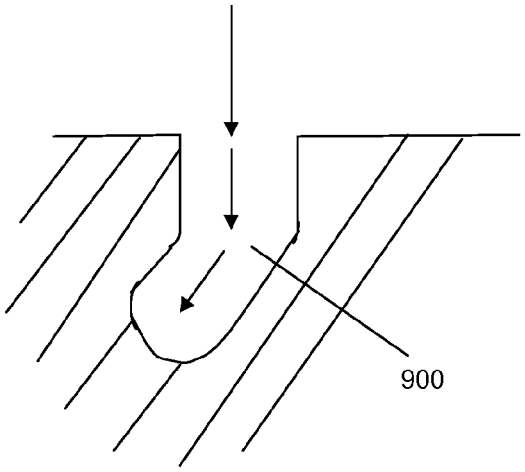
Figure 9C:
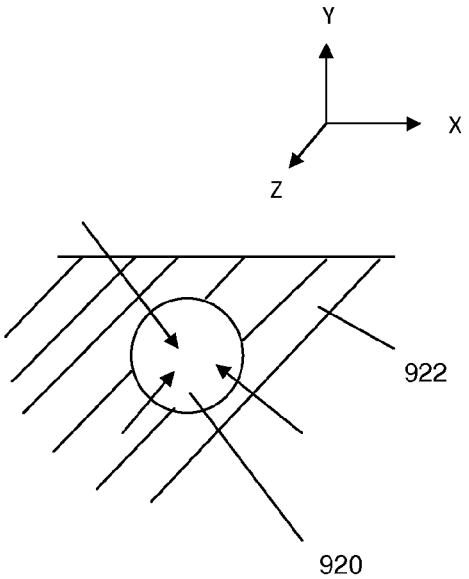

FIG. 9(*a*) and (*b*) are schematic drawings illustrating cross-sections of possible open ended slots in accordance with various embodiments disclosed herein.

FIG. 9(*c*) is a schematic drawing illustrating a cross-section of a non-open ended slot as a comparison against open ended slots of the various embodiments disclosed herein.

Referring to FIG. 9(*a*), one example embodiment of an open ended slot 800 having a substantially "U" shape is shown. It will be appreciated that the open ended slot 800 can also comprise at least one of a trough, valley, depression or channel in various embodiments. One end of the open ended slot is open to allow access by an arm of a flag structure. The shape of the open ended slot may be complementary to a projection of the flag structure. In this example embodiment, the open ended slot comprises a top open end.

Access of the arm of the flag structure into the open ended slot is in a substantially top to bottom direction (e.g. substantially along the Y-axis) as shown by the arrow in FIG. 9(*a*). The open ended slot may be opening that is defined byone face of a wall 802 of a base to an opposing face of another wall 804 of the base. The open ended slot may also be made such that a side wall blocks the slot to prevent the arm of the flag structure from accessing the slot along the Z-axis.

Referring to FIG. 9(*b*), another example embodiment of an open ended slot 900 having a non-symmetrical shape is shown. Access of the arm of the flag structure into the open ended slot is in a substantially top to bottom direction (as shown by the arrows in FIG. 9(*b*). For example, the open ended slot can be substantially straight near the top open end and ends at an angle to the substantially straight portion. Thus, in this embodiment, the bottom part of the open ended slot is offset from the top part of the open ended slot. Advantageously, this reduces the likelihood of the projection of the flag structure being accidentally dislodged from the open ended slot.

An example of a non-open ended slot is shown in FIG. 9(*c*). A non-open ended slot 920 is fully closed and in this case, is defined by a closed circle. Access of an arm of a flag structure into the open ended slot in a substantially top to bottom direction (e.g. Y-axis) is no longer possible due to the closed ends. In fact, access in any direction (shown by the arrows in FIG. 9(*c*)) along the X-Y plane is not possible. The flag structure can only be inserted through the circular opening via the Z-axis.

As will be appreciated by comparison of FIGS. 9(*a*) and 9(*b*) with FIG. 9(*c*), by having an open ended slot, it is easier for a flag structure to be inserted into the slot without substantially deforming the flag structure. In an example embodiment, an open ended slot also allows a rib of a housing to rest on a projection of the flag structure to prevent the flag structure from being accidentally dislodged. This allows the flag structure to better engage with the open ended slot to pivot about a projection of the flag structure. On the contrary, when a non-open ended slot is used, the flag structure may only be inserted into the slot by firstly deforming the flag structure. When the deflection force is released, the arms of the flag structure are urged against walls defining the non-open ended slot (for e.g. walls 922 of FIG. 9(*c*)). This may also hamper the movement of the flag structure due to increased contact friction and may make the relay more susceptible to damage.

Process of assembling a relay is also easier and more straight forward when an open ended slot is used since the flag structure only needs to be slotted into the open opened slot. No complicated tooling may be needed to be engaged for such assembly process.

Figure 10:
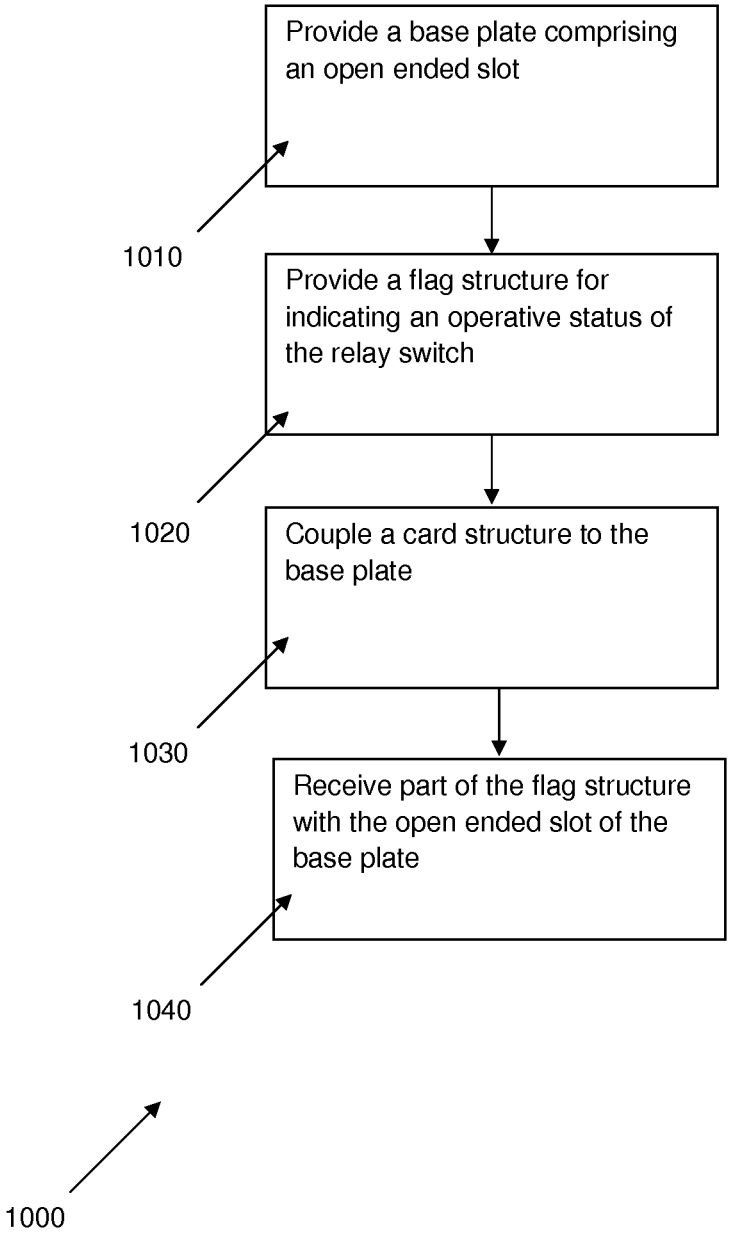
FIG. 10 is a schematic drawing of an exemplary embodiment of a method of assembling a relay.

FIG. 10 is a schematic drawing for broadly illustrating an exemplary embodiment of a method of assembling a relay disclosed herein.

Referring to FIG. 10, a method of assembling 1000 a relay disclosed herein comprises step 1010 wherein a base plate comprising an open ended slot is provided.

In step 1020, a flag structure for indicating an operative status of the relay switch is provided. The flag structure is capable of being orientated in a first position for indicating the relay switch being in the first switch mode and in a second position for indicating the relay switch being in the second switch mode.

In step 1030, a card structure is coupled to the base plate. The card structure is capable of changing the orientation of the flag structure from the first position to the second position or from the second position to the first position.

In step 1040, part of the flag structure is slotted into the open ended slot of the base plate. Step 1040 may comprise slotting the part of the flag structure into the open ended slot without substantially deforming the flag structure.

In some embodiments, step 1030 may be carried out after step 1040.

The card structure may comprise a supporting platform and the flag structure may comprise a shaft. The method of assembling a relay may further comprise engaging the supporting platform of the card structure with the shaft of the flag structure.

It will be appreciated by a person skilled in the art that other variations and/or modifications may be made to the specific embodiments without departing from the scope of the invention as broadly described. The present embodiments are, therefore, to be considered in all respects to be illustrative and not restrictive.

What is claimed is:

1. A relay comprising:

a relay switch configured to operate in a first switch mode and a second switch mode;

a flag structure for indicating an operative status of the relay switch, the flag structure capable of being orientated in a first position for indicating the relay switch being in the first switch mode and in a second position for indicating the relay switch being in the second switch mode;

a card structure coupled to the flag structure for changing an orientation of the flag structure from the first position to the second position or from the second position to the first position; and a base plate coupled to the flag structure and the card structure, the base plate comprising an open ended slot for allowing part of the flag structure to be received therein, wherein the flag structure comprises projections for slotting into the open ended slot of the base plate to provide a pivoting point for changing the orientation of the flag structure, and wherein the relay further comprises a housing for coupling with the base plate and for preventing the projections of the flag structure from dislodging from the open ended slot of the base plate through the open ended slot.

2. The relay as claimed in claim 1, wherein the first switch mode corresponds to the relay operatively providing electrical communication to an external circuit and the second switch mode corresponds to the relay operatively disrupting electrical communication to the external circuit.

3. The relay as claimed in claim 2, wherein the open ended slot is configured to allow part of the flag structure to be received therein without substantial deformation of the flag structure.

4. The relay as claimed in claim 1, wherein the card structure comprises a supporting platform for receiving part of the flag structure and for transmitting a force to the flag structure to change the orientation of the flag structure.

5. The relay as claimed in claim 4, wherein the flag structure further comprises:

a first arm and a second arm;

a lip coupled to the first arm and the second arm for indicating the operative status of the relay switch; and a shaft coupled to the first arm and the second arm, the shaft configured to engage the supporting platform of the card structure, wherein the projections for being received in the open ended slot of the base plate comprises a projection extending from the first arm and a projection extending from the second arm.

6. The relay as claimed in claim 5, wherein the shaft extends from the first arm to the second arm.

7. The relay as claimed in claim 6, wherein the projections are disposed at ends of the first and second arms.

8. The relay as claimed in claim 7, wherein the projection of the first arm and the projection of the second arm extend outwards away from each other.

9. The relay as claimed in claim 1 wherein the housing comprises a window for allowing visual access to the lip of the flag structure when the flag structure is in the first position or the second position or both.

10. The relay as claimed in claim 9, wherein the window is substantially transparent.

11. The relay as claimed in claim 10, wherein the flag structure is substantially non-deformable.

12. A flag structure for use in a relay, the flag structure comprising:

a first arm and a second arm;

a lip coupled to the first arm and the second arm for indicating an operative status of a relay switch;

a shaft coupled to the first arm and the second arm, the shaft configured to engage a supporting platform of a card structure of the relay;

a projection extending from the first arm; and a projection extending from the second arm, wherein the projection of the first arm and the projection of the second arm are arranged to be received by an open ended slot of a base plate to provide a pivoting point for changing an orientation of the flag structure, and wherein the relay further comprises a housing for coupling with the base plate and for preventing the projection of the first arm and the projection of the second arm of the flag structure from dislodging from the open ended slot of the base plate through the open ended slot.

13. The flag structure as claimed in claim 12, wherein the shaft extends from the first arm to the second arm.

14. The flag structure as claimed in claim 13, wherein the projections are disposed at ends of the first and second arms.

15. The flag structure as claimed in claim 14, wherein the projection of the first arm and the projection of the second arm extend outwards away from each other.

16. The flag structure as claimed in claim 15, wherein the flag structure is substantially non-deformable.

17. A flag assembly for use in a relay, the flag assembly comprising:

a flag structure for indicating an operative status of a relay switch of the relay, the flag structure comprising:

a first arm and a second arm;

a lip coupled to the first arm and to the second arm for indicating the operative status of the relay switch; and a shaft coupled to the first arm and to the second arm for receiving a force to thereby change an orientation of the flag structure; and a card structure coupled to the flag structure, the card structure comprising a supporting platform for receiving the shaft of the flag structure and for transmitting the force to the flag structure to change the orientation of the flag structure, wherein the flag structure comprises projections for slotting into an open ended slot of a base plate to provide a pivoting point for changing the orientation of the flag structure, and wherein the relay further comprises a housing for coupling with the base plate and for preventing the projections of the flag structure from dislodging from the open ended slot of the base plate through the open ended slot.

18. The flag assembly as claimed in claim 17, wherein the flag structure further comprises:

a projection extending from the first arm; and a projection extending from the second arm, wherein the projection of the first arm and the projection of the second arm are arranged to be received by the open ended slot of the base plate of the relay.

19. The flag assembly as claimed in claim 18, wherein the projections are disposed at ends of the first and second arms.

20. The flag assembly as claimed in claim 19, wherein the projection of the first arm and the projection of the second arm extend outwards away from each other.

21. The flag assembly as claimed in claim 20, wherein the flag structure is substantially non-deformable.

22. A method of assembling a relay comprising:

providing a base plate comprising an open ended slot;

providing a flag structure for indicating an operative status of a relay switch of the relay, wherein the flag structure is capable of being orientated in a first position for indicating the relay switch being in a first switch mode and in a second position for indicating the relay switch being in a second switch mode;

coupling a card structure to the base plate, wherein the card structure is capable of changing an orientation of the flag structure from the first position to the second position or from the second position to the first position; and receiving part of the flag structure with the open ended slot of the base plate, wherein the flag structure comprises projections for slotting into the open ended slot of the base plate to provide a pivoting point for changing the orientation of the flag structure, and wherein the relay further comprises a housing for coupling with the base plate and for preventing the projections of the flag structure from dislodging from the open ended slot of the base plate through the opened ended slot.

23. The method of claim 22 wherein the step of receiving part of the flag structure with the open ended slot of the base plate comprises receiving a part of the flag structure including the open ended slot without substantially deforming the flag structure.

24. The method of claim 23 wherein the card structure comprises a supporting platform and the flag structure comprises a shaft, and wherein the method further comprises engaging the supporting platform of the card structure with the shaft of the flag structure.

* * * * *